US010105810B2

(12) United States Patent
Granlund et al.

(10) Patent No.: US 10,105,810 B2
(45) Date of Patent: Oct. 23, 2018

(54) MECHANOCHEMICAL CONDITIONING TOOL

(71) Applicant: APPLIED NANO SURFACES SWEDEN AB, Uppsala (SE)

(72) Inventors: Mattias Granlund, Bromma (SE); Jonas Lundmark, Uppsala (SE); Boris Zhmud, Skogås (SE)

(73) Assignee: APPLIED NANO SURFACES SWEDEN AB, Uppsala (SE)

( * ) Notice: Subject to any disclaimer, the term of this patent is extended or adjusted under 35 U.S.C. 154(b) by 2 days.

(21) Appl. No.: 15/531,946

(22) PCT Filed: Dec. 2, 2015

(86) PCT No.: PCT/SE2015/051293
§ 371 (c)(1),
(2) Date: May 31, 2017

(87) PCT Pub. No.: WO2016/089289
PCT Pub. Date: Jun. 9, 2016

(65) Prior Publication Data

US 2017/0326704 A1 Nov. 16, 2017

(30) Foreign Application Priority Data

Dec. 5, 2014 (SE) ..... 1451491

(51) Int. Cl.
*B24B 33/02* (2006.01)
*B24B 33/08* (2006.01)
(Continued)

(52) U.S. Cl.
CPC ..... *B24B 33/02* (2013.01); *B24B 5/40* (2013.01); *B24B 33/08* (2013.01); *B24B 33/10* (2013.01)

(58) Field of Classification Search
CPC ..... B24B 5/40; B24B 33/02; B24B 33/08; B24B 33/083; B24B 33/10
(Continued)

(56) References Cited

U.S. PATENT DOCUMENTS 1,654,509 A 12/1927 Claus
1,781,856 A * 11/1930 Moser ..... B24B 33/08 451/472
(Continued)

FOREIGN PATENT DOCUMENTS

DE 10 2006 017 990 A1 10/2007
EP 0 169 667 A1 1/1986
(Continued)

*Primary Examiner* — Eileen Morgan
(74) *Attorney, Agent, or Firm* — Birch, Stewart, Kolasch & Birch, LLP

(57) ABSTRACT

A tool (1) for mechanochemical treatment comprises a shaft (10), a number n of working ledges (20), n≥1, and a force application arrangement (2). The force application arrangement (2) is configured for applying a working force (F) on the working ledges (20). The working ledges (20) comprises wear-resistant material with a Vickers number above 800 HV and a Young modulus above 200 GPa. Each working ledge (20) has a contact surface (22) facing away from a main axis (11) and having a surface roughness Ra below I μm. The contact surface (22) has a convex curvature which has a radius of curvature that is at most equal to a closest distance from that point to the main axis. A width of the contact surface (22) is less than r/2n. The working force applied on each working ledge (20) is at least P−L−r/2n, where P=107 Pa and L is the contact surface length.

15 Claims, 10 Drawing Sheets

(51) Int. Cl.
*B24B 5/40* (2006.01)
*B24B 33/10* (2006.01)

(58) Field of Classification Search
USPC ..... 451/120, 472, 474, 476
See application file for complete search history.

(56) References Cited

U.S. PATENT DOCUMENTS 1,889,664 A * 11/1932 Jeschke ..... B24B 33/08 451/474
1,955,362 A * 4/1934 Floss ..... B24B 33/08 451/472
2,000,330 A * 5/1935 High ..... B24B 33/00 451/481
2,004,949 A 6/1935 Isom
2,284,134 A * 5/1942 Connor ..... B24B 33/08 451/143
2,710,497 A * 6/1955 Kushmuk ..... B24B 33/084 451/474
2,790,278 A * 4/1957 Smith ..... B24B 33/08 451/478
3,126,672 A * 3/1964 Calvert ..... B24B 33/02 451/150
3,857,208 A * 12/1974 Harris, Jr. ..... B24B 33/08 451/478
4,486,983 A 12/1984 Sunnen et al.
4,629,547 A 12/1986 Honda et al.
5,305,556 A * 4/1994 Kopp ..... B06B 3/00 451/124
5,363,821 A 11/1994 Rao et al.
8,839,514 B2 * 9/2014 Scharf ..... B24B 1/00 118/76
2002/0155957 A1 10/2002 Danly, Sr. et al.
2005/0130560 A1 * 6/2005 Klink ..... B24B 33/02 451/5
2005/0214540 A1 9/2005 Maslar
2006/0068686 A1 * 3/2006 Esslinger ..... B24B 33/02 451/21
2007/0298685 A1 * 12/2007 Cloutier ..... B23Q 17/2233 451/5
2010/0029179 A1 * 2/2010 Cloutier ..... B23Q 15/225 451/9
2010/0210181 A1 * 8/2010 Moehn ..... B24B 33/02 451/5
2010/0272931 A1 10/2010 Stavlid
2013/0104357 A1 5/2013 Zhmud
2016/0303702 A1 * 10/2016 Xavier ..... B24B 33/088

FOREIGN PATENT DOCUMENTS

EP 1 528 123 A1 5/2005
GB 596318 1/1948
GB 776502 6/1957
GB 782263 9/1957
JP 2004-076914 A 3/2004
WO WO 03/091479 A1 11/2003

* cited by examiner

MECHANOCHEMICAL CONDITIONING TOOL

TECHNICAL FIELD

The present invention relates generally to devices and methods for enhancing tribological properties of cylinder bores and in particular to devices and methods for mechanochemical surface finishing.

BACKGROUND

Friction between moving piston assembly parts and cylinder bore accounts for the largest part of mechanical energy losses in internal combustion engines. Friction also leads to piston ring wear which affects compression sealing and oil consumption. Therefore, there is a general request to provide cylinder bore surfaces having as low friction and experiencing as little wear as possible, while maintaining their optimal tribological properties from the first day in exploitation and for entire engine life span.

Prior-art approaches to provide low-friction surfaces comprise use of PVD and CVD coatings, plasma-sputtering, solid lubricants films and polymer-bonded solid lubricant coatings. Thus, the published US patent application 2005/0214540 describes PVD/CVD coatings for pistons, and the U.S. Pat. No. 4,629,547 describes low-friction boron-containing films obtained by plasma sputtering. The utility of certain solid film lubricants has been known for quite some time. Here below are just a few examples presented. The U.S. Pat. No. 1,654,509 describes the use of graphite embedded into a metal binder to make an antiwear coating for bearings. The published British patent application GB 776502 A describes protective films formed by treatment with vaporized reactive substances containing phosphorus, sulfur, selenium or halogen atoms. GB782263 shows that sulfurization of ferrous metal parts by heating the parts to a temperature above 500° C. in a fused salt bath containing alkali metal cyanide, alkali metal cyanate and active sulfur improves resistance to wear and seizure. The published international patent application WO03/091479A describes chemical treatment for piston rings and pistons by heating in oil containing appropriate additives. The U.S. Pat. No. 5,363,821 discloses use of graphite, $MoS_2$, BN solid lubricants incorporated into a polymeric carrier/binder for making antifriction coatings at the cylinder bore walls by spray-application with subsequent thermal fixation. The Japanese patent application 2004-76914 discloses a method for production of a low friction coating by encapsulation of molybdenum and sulfur into a polyamideimide resin matrix.

Common for most solid lubricant systems is that the lubricant is deposited onto the surface either as a pure lubricant substance or as a lubricant in a bearer substance. The deposition can be followed by different kinds of post treatments, typically thermal treatments. The lubricants will thus be provided as a layer on top of the surface to be lubricated.

A manufacturing method to produce low-friction surfaces by using a mechanochemical process, conditioning by means of tribochemical reactions, has been described in the published US patent application 2013/0104357 A1 or the published US patent application 2010/0272931 A1. The method involves rubbing a hard tool against the component surface while applying a sufficiently high load in the presence of a process fluid containing refractory metal dichalcogenides solid lubricant precursors. Conditioning by means of tribochemical reactions has been shown to lead to significant improvement in terms of surface roughness, wear resistance and friction reduction. In contrary to other previous solid lubricant systems, the so produced surface composition is created as a modification of the original surface and becomes thus an integrated part of the originally provided surface.

The Conditioning treatment by means of tribochemical reactions can be viewed as an in-manufacture running-in process. Running-in, or breaking-in, of an engine smoothes down surface irregularities and reduces localized pressure between various rubbing parts; the ring/bore system and valve train, especially for flat-tappet cammed engines, being the primary points of concern. Whereas engine running-in is a well-established procedure for training new or rebuilt engines in order to maximize their power output and durability, it has never been attempted to carry it out at a component level—as a dedicated finishing operation during the component manufacture. Doing so allows one to optimize processing conditions for each component individually, thus maximizing the effect of the treatment.

This new type of surface treatment was initially performed using standard honing tools that have been equipped with working stones with very hard surfaces. Examples of standard honing tools can be found e.g. in the U.S. Pat. Nos. 1,955,362 and 2,004,949. However, since conditioning by means of tribochemical reactions, in contrast to traditional honing, is a non-abrasive method, operation based on prior art honing equipment with honing stones replaced by hard surface working stones was found to be far from ideal. It was for instance found that tool preparation took unreasonably long time, tool service life was far too short, process stability was poor, and the outcome of the treatment could vary from one setup to another.

SUMMARY

A general object of the present technical presentation was to provide methods and devices having improved treatment efficiency and reproducibility.

These objects were achieved by devices and methods according to the enclosed independent patent claims. Preferred embodiments are defined in dependent claims. In general words, in a first aspect, a tool for mechanochemical treatment of a cylinder bore comprises a shaft, having a main axis, a number n of working ledges, where n is equal to or larger than 1, and a force application arrangement. The force application arrangement is configured for applying a working force, directed away from the main axis, on the working ledges. The working ledges comprises wear-resistant material with a Vickers number above 800 HV and a Young modulus above 200 GPa. Each working ledge has a, parallel to the main axis generally elongated, contact surface. The contact surface faces away from the main axis and the contact surface is fine-polished and essentially non-abrasive, having a surface roughness Ra below 1 μm. The contact surface has a convex curvature in a cross-section perpendicular to the main axis. The convex curvature has, in each point of said contact surface, a radius of curvature that is equal to or less than a closest distance from that point to the main axis. A width of the working ledge in a circumferential direction centred around the main axis is less than r/2n, where r is the maximum distance between the contact surface and the main axis. The working force applied on each working ledge is at least $P \cdot L \cdot r/2n$, where $P=10^7$ Pa and L is the length, parallel to the main axis, of the contact surface of the working ledge.

One advantage with the presented technology is that the conditioning by means of tribochemical reactions can be performed with a uniform and reproducible contact pressure. Other advantages are described in connection with the exemplary embodiments described here below.

BRIEF DESCRIPTION OF THE DRAWINGS

The invention, together with further objects and advantages thereof, may best be understood by making reference to the following description taken together with the accompanying drawings, in which.

DETAILED DESCRIPTION

Figure 1:
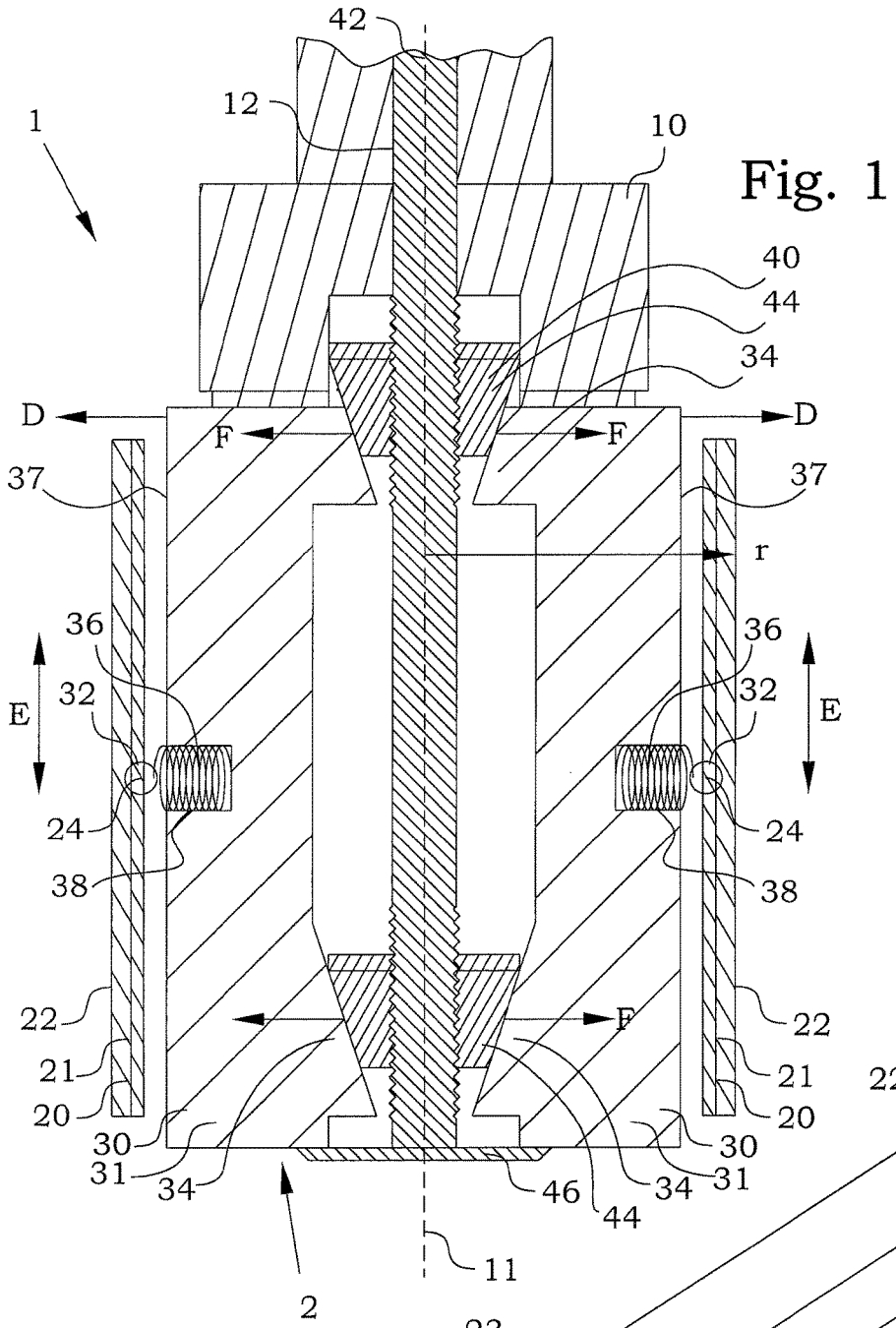
FIG. 1 is a partly cross-sectional illustration of an embodiment of a tool for mechanochemical treatment of a cylinder bore.

Throughout the drawings, the same reference numbers are used for similar or corresponding elements.

In one approach to provide a tool for in-manufacture running-in of cylinder bores by conditioning by means of tribochemical reactions is based on using a machine having some features in common to a prior art honing machine. The idea of using a honing-like machine for in-manufacture running-in of cylinder bores was conceived by the present inventors a long time ago. Specifically, it has been mentioned previously that the treatment preferably is performed by replacement of original hones, also known as honing stones, by a set of hard surface working ledges and replacement of honing oil by a special process fluid containing a tungsten source and a sulfur source. However, actual technical design elements essential for providing an industrially applicable process have been never disclosed earlier.

When performing pilot test runs on in manufacture running-in of cylinder bore, it was found that the outcome of the treatment differed a lot from one setup to another, and that the overall stability of the process was in general unsatisfactory. Upon detailed analysis, it was found that the differences in operation between traditional honing and a conditioning treatment by means of tribochemical reactions put new demands on the design of the tool.

One important difference is the wear properties of the working stones. A regular honing stone, also known as a hone, is basically a consumable part. This means that even if the original mounting provides a slightly misaligned honing stone, the working surface will anyway quite soon be conformal with the cylinder bore due to wear of the honing stone. Also, if one honing stone is mounted at a slightly larger radius than the other honing stones giving an original situation where only one honing stone is in contact with the cylinder bore, the wear of that honing stone will soon compensate for this radius deviance and the other honing stones will soon be in contact with the cylinder bore.

For a working stone intended for conditioning by means of tribochemical reactions, the situation is completely different. The tribochemical reactions are driven by friction energy typically caused by rubbing a working surface under high pressures against the surface to be treated. In order to provide the right conditions, the working surface has to be very hard. This normally also implies that the working surface is highly wear resistant. Since the wear on the working surface is extremely slow, the relative positions of the working stones in the radial direction as well as in relation to the cylinder bore have to be controlled in a very exact manner in order to achieve an efficient conditioning operation. Also, since the wear typically is neglectable, the surface structure of the working surface has to be very smooth already from the beginning.

Therefore, in an embodiment of a tool for conditioning by means of tribochemical reactions, each working ledge has a contact surface. The contact surface is generally elongated along a direction parallel to a main axis of a shaft of the tool. In other words, elongated contact surfaces are aligned with the main axis. The contact surface faces away from the main axis in order to allow for a contact with a surface to be treated, e.g. the inner surface of a cylinder bore. The contact surface is fine-polished and essentially non-abrasive. This is in contrast to regular hones, since the conditioning by means of tribochemical reactions benefits from minimizing the material removal. The contact surfaces of the working ledges have a surface roughness $R_a$ (ISO 4287, ASME B46.1) below 1 μm, preferably, below 0.1 μm, and even more preferably, below 0.05 μm. The contact surface has a convex curvature in a cross-section perpendicular to the main axis. The convex curvature has, in each point of the contact surface, a radius of curvature that is equal to or less than a closest distance from that point to the main axis. In other words, the curvature should not flatter than an inner surface of a cylinder bore, with a radius equal to that distance, centred around the main axis. This allows for a close positioning along a concave surface to be treated without risking to expose the surface to be treated for edges on the working tool.

The tools for conditioning by means of tribochemical reactions are preferably required to allow for a maximum contact pressure of the same order of magnitude as the typical yield stress values of the bore materials. This is achieved by using ledges having contact surfaces made of a material with a Vickers number (ISO 6507, ASTM E384) above 800 HV and a Young modulus above 200 GPa. Preferably, the contact surface has a Vickers number above 1600 HV. Preferably, the contact surface has a Young modulus above 400 GPa. Suitable materials are e.g. cemented metal carbides, reaction bonded silicon nitride, hot pressed silicon nitride, sintered silicon nitride, gas pressure sintered silicon nitride, hot pressed boron carbide, high speed steel, and similar materials.

In order to perform a process of conditioning by means of tribochemical reactions, the contact pressure has to be high. A typical practical lower limit is believed to be around 10 MPa. For smaller pressures, there might in certain systems still be a process of conditioning by means of tribochemical reactions, however, it is considered to become generally too slow to be used in commercial systems. For instance, for cylinder liners made of centrifugally cast ductile iron (ASTM 536-84, DIN 1693 GGG70), the preferred contact pressure should be over 50 MPa, even more preferably over 100 MPa and most preferably over 200 MPa, as long as the ultimate strength of the material is not exceeded.

If one uses a traditional honing equipment and replaces the honing stones with equally shaped hard surface working stones with the intension to perform a conditioning by means of tribochemical reactions, some problems will arise. The honing stones are adapted for maximizing the abrasive action on the surface to be treated. Therefore, honing stones present in general broad contact surfaces. In order to reach the requested ranges of contact pressures for achieving tribochemical reactions, the total force that is required to press the working stones against the surface to be treated becomes very high indeed. The tool has to be designed in a very rigid manner, which increases the complexity, cost and weight. For many prior art honing tools, such required forces are not possible to achieve without extensive design alterations.

Furthermore, using working stones with a geometrical shape similar to honing stones will as mentioned require a high pressing force. This high pressing force will be applied to the surface to be treated. In some applications, the structure supporting the surface to be treated is not very rigid and in many applications, such total force may increase the risk for deformation of the object to be treated. It is therefore a requirement in many applications to have an upper limitation for the allowed applied total force. At the same time, in order to perform conditioning by means of tribochemical reactions a high pressure has to be provided.

In order to solve these contradictory requirements, the dimensions of the ledges are preferably chosen so as to stay within the runnability window of the process of conditioning by means of tribochemical reactions in terms of the preferred contact pressure, while still staying within the operational load range of the machine holding the stones and the maximum allowed force on the object to be treated. In general words, the working ledges are made narrow. Honing stones are typically as broad as possible in order to maximize the abrasive area of the contact surface between the tool and the surface to be treated. Narrow honing stones are therefore non-preferred. For instance, in the U.S. Pat. No. 2,004,949, the honing stones occupy approximately 25-30% of the total circumference area. Another reason for keeping honing stones relatively broad is to avoid that the tangential forces will break the stones.

The conditions for working ledges intended for conditioning by means of tribochemical reactions are, however, completely different. Here, the local pressure is of main importance, and narrow contact surfaces can then by advantage be used. Since the material in the working ledges intended for conditioning by means of tribochemical reactions is extremely tough, the risk for cracking the working ledges by the tangential forces is still low.

In preferred embodiments, the working stones are preferably shaped as ledges in order to have a relatively large extension in the axial direction while keeping the extension in the tangential direction small to increase the contact pressure. The working stones of the present disclosure will therefore be denoted as working ledges and when being suitable for use during conditioning by means of tribochemical reactions, they occasionally are denoted as working ledges for mechanochemical treatment.

It has been found that tribochemical reactions are initiated when a certain minimum force is applied on each working ledge. This imposes certain limitations on ledge width as reasonably narrow ledges are required in order to achieve sufficient contact pressure without deforming cylinder at the same time. In practice, the contact surfaces of the all ledges together occupy at the most about 8% of the circumference of the cylinder to be treated. In other words, 8% of a circular circumference is about 0.5 r, where r is the radius. Each of the n narrow ledges then has a maximum width of 0.5r/n or r/2n. This is a substantially smaller fraction than what is normally used during a honing operation. Preferably, the width is less than r/4n, and most preferably less than r/8n. The working force applied on each working ledge should then be at least $P \cdot L \cdot r/2n$, where $P=10^7$ Pa and L is the length, parallel to the main axis, of the contact surface of the working ledge. This corresponds to a pressure of the order of magnitude of 10 MPa provided on the working ledges of the preferred width.

For extremely narrow working ledges, there is an increased risk for causing a cutting operation into the surface to be treated, causing chipping. In order to avoid such damages, the tip of the working ledge has to be carefully rounded off or provided with any other non-cutting geometry.

Another aspect that is different between conventional honing stones and working stones for purposes of conditioning by means of tribochemical reactions is compensation for working stone wear in the radial direction. Honing stones are as mentioned worn relatively rapidly and in order to continue to reach the cylinder bore surface, the change in radius preferably has to be compensated for. Different prior art honing approaches utilizing springs are found in e.g. the U.S. Pat. No. 1,484,353, or the published German patent applications DE102009030451A1, DE102010032453A1 and DE102011118588A1. In most of them, springs are mounted between the shaft and the honing stones, and upon wear of the honing stones, the springs will expand and compensate for the wear. This is perfectly feasible at the contact pressures and wear rates used in conventional honing. In the U.S. Pat. No. 1,955,362 and U.S. Pat. No. 2,004,949 mentioned also in the background, the honing stones are provided on holders that are possible to control in a radial direction, thereby allowing compensation for e.g. wear. However, such compensation has to be performed manually However, in conditioning by means of tribochemical reactions, the contact forces are very high indeed, but the distances needed to be compensated for are instead very small. In such situations, a solution where a spring provides both the distance compensation and load equalization is less suitable. Preferred embodiments are therefore based on solutions where at least a part of an initial distance compensation is made by other means than springs, but where springs are assisting in compensation for fine adjustment and/or any minor wear.

From these considerations, it is now also understood that the contact surfaces of a conditioning by means of tribochemical reactions tool preferably are tiltably attached relative to a main shaft around a tilt axis that is directed perpendicular to the main shaft and perpendicular to a radial direction. The contact surfaces should also as mentioned above preferably be movable in a radial direction. Furthermore, the application of a working force onto the contact surfaces should preferably be essentially independent of the radial position of the contact surfaces.

The ledges are preferably assembled in multi-ledge arrays providing equal loading on each individual ledge, and dynamic self-alignment of each ledge for achieving a conformal contact with the bore surface. This will be discussed more in detail further below.

The ledge geometry is preferably chosen so as to compensate for the small but inevitable ledge wear and to guarantee steady process parameters over the tool service life.

The ledge mounting mechanism is preferably designed so as to allow easy ledge replacement during service.

FIG. 1 illustrates an embodiment of a tool 1 for mechanochemical treatment of a cylinder bore. The tool 1 comprises a shaft 10 having a main axis 11. The tool 1 has at least one working ledge 20. In the present embodiment, four working ledges 20 are spread evenly around the main axis 11. Each of the working ledges 20 is in this embodiment a working ledge 21 for mechanochemical treatment.

Figure 2:
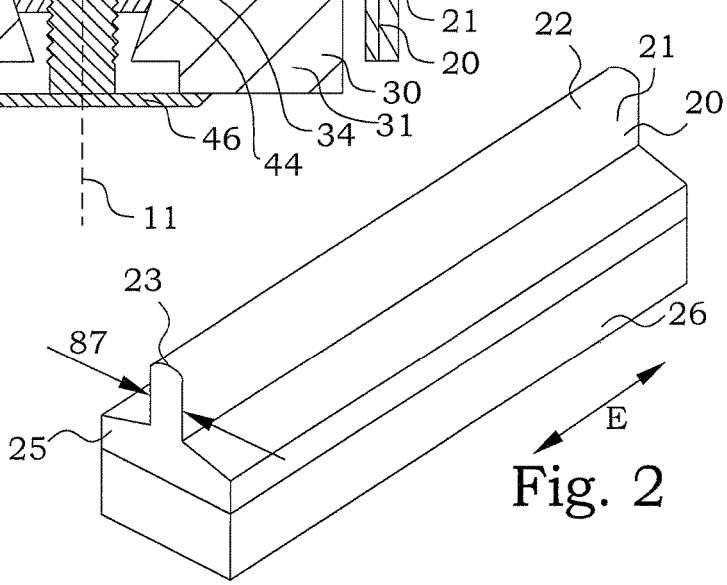
FIG. 2 is an illustration of an embodiment of a working ledge.

An embodiment of a working ledge 20 possibly used in the embodiment of FIG. 1 is illustrated in more detail in FIG. 2. The working ledge 20 comprises in this embodiment contact part 25 and a base part 26. The base part 26 is here used for the attachment of the working ledge 20 and for making the working ledge 20 stiffer.

In alternative embodiments, the entire working ledge may be provided in one single piece.

The working ledge 20 has a generally elongated contact surface 22. The contact surface 22 has a convex curvature 23 in a cross-section perpendicular to an elongation direction E of the contact surface 22, i.e. perpendicular to the main axis. The convex curvature 23 has, in each point of the contact surface 22, a radius of curvature that is equal to or less than a closest distance r (in FIG. 1) from that point to the main axis. In other words, the convex curvature 23 of the contact surface 22 should be at least as convex as a circularly cylinder surface with a radius equal to the distance r (FIG. 1) from the main axis to the contact surface 22. This convex curvature 23 has preferably a radius that is equal to the inner radius of the cylinder bore to be treated. In such a way, a contact between the contact surface and the cylinder bore will be essentially a line contact with a predetermined width essentially equal to the width of the contact surface 22. The convex curvature 23 is constant along essentially the entire elongation of the contact surface 22. This makes it possible to have a line contact that has essentially the same length as the working ledge 20.

The contact surface 22 of the working ledge 20 is narrow in the direction perpendicular to the main extension E. As discussed above, and that will be discussed further below, a width 87 of the contact surface 22 should only occupy a small fraction of the circumferences of the tool.

Returning to FIG. 1, each of the working ledges 20 is attached by an attachment 32 to a respective ledge support arrangement 30. This attaching is made such that the contact surface 22 is directed radially outwards, with respect to the main axis 11 and with the elongation direction E parallel to the main axis 11. The ledge support arrangements 30 are movable in a respective support displacement direction D directed radially with respect to the main axis 11. The ledge support arrangement 30 can be provided as an integrated part of the main tool or as a separate part.

The attachment 32 of the working ledges 20 to respective ledge support arrangement 30 is configured for allowing a tilting of the working ledge 20 around a respective tilt axis 24. The tilt axis 24 is directed perpendicular to the main axis 11 and perpendicular to the respective support displacement direction D. In the present embodiment, a pivoting of approximately ±1.5° is permitted.

A force application arrangement 2 comprises an actuator 40, supported by the shaft 10 and arranged for applying a respective working force F on the respective ledge support arrangements 30. The ledge support arrangement 30 can thereby be considered as being a part of the force application arrangement 2. The working forces F are directed radially outwards, with respect to the main axis 11. In this embodiment, having more than one working ledge 20, the actuator 40 is arranged for applying a respective working force F on the respective ledge support arrangements 30 of a same magnitude.

In the present embodiment, the actuator 40 is based on a mechanical transfer of an axial force into a radial force via cone action. In other embodiments, other solutions for providing the working forces F can be used. Possible other embodiments may be based on magnetic and/or electric interactions and/or other mechanical designs, known, as such, in prior art. The actual detailed way in which the forces are provided is not essential for the basic parts of the present ideas. The embodiment shown in the present disclosure is only given as one particular example of how it can be implemented. However, in the present embodiment, the actuator 40 comprises a rod 42 provided through a central hole 12 in the shaft 10. Two cones 44 with threaded holes are provided around threaded parts of the rod 42, The interaction between the rod thread and the cone hole thread causes the cones 44 to move upwards or downwards when the rod 42 is rotated around its axis. An end plate 46 is attached to the end of the rod 42. When the rod 42 is turned in a first direction, the cones 44 are urged downwards in the figure with a particular force. This force is transferred into a radial force acting as the working force F by interaction with inclined surfaces 34 on the ledge support arrangements 30. The inclined surfaces 34 are preferably parts of a conical surface conformal with the cones 44. The inclination determines the relation between the axial force of the cones 44 and the resulting working force F on the ledge support arrangements 30. The ledge support arrangements 30 are movable in radial direction and are pushed outwards until the working ledges 20 are coming into contact with the cylinder bore. Such a force application arrangement 2 is, as such, know from prior art and is given here just as a possible example of an actuator design.

In the embodiment of FIG. 1, the ledge support arrangements 30 are as mentioned above movable in the radial direction. However, if the mounting of the working ledges 20 onto the ledge support arrangements 30 is not exactly equal for all working ledges 20 or the geometric dimensions of the working ledges 20 or ledge support arrangements 30 are not perfectly the same, the action of the actuator will not cause a simultaneous contacting of all working ledges 20 with the cylinder bore at the same time. One set of working ledge 20 and ledge support arrangement 30 might be somewhat longer than another. In this embodiment, this is adjusted for by using force application arrangements 2 that are resilient in the support displacement direction D. In this embodiment, the force application arrangement 2 comprises a resilient member 36 arranged between the actuator 40 and the working ledge 20. In this particular embodiment, the resilient member 36 is constituted by a spring 36 operating in the support displacement direction D. The springs are provided in recesses 38 of the ledge support arrangements 30 for greater compactness, however, the top of the resilient member 36 protrudes somewhat outside a main outer surface 37 of the edge support arrangement 30. The attachment 32 is in this embodiment provided at the outer end of the resilient member 36 while the inner end of the resilient member 36 is supported by the bottom of the recess 38.

When the tool 1 is introduced into a cylinder bore to be treated and the actuator is activated to provide the working force F, the ledge support arrangements 30 are pushed outwards until a first working ledge 20 is coming into contact with the inner surface of the cylinder bore. The corresponding spring starts to compress and create a force moving the tool in an opposite direction. All working ledges 20 are sooner or later coming into contact with the cylinder bore and the springs will then adjust the position of the tool 1 until essentially the same force is applied on all working ledges 20. The axis 11 of the tool will then in a general case not coincide perfectly with the axis of the cylinder bore, but the deviances are typically so small that the displacement can be neglected. However, all working ledges 20 are exposed for the same contact force.

Since the amount of adjustment typically is very small, the resilient member 36 may have a relatively high spring constant. Tests have shown that spring constants of the order of 2 MN/m may be required, depending on the actual design of the working ledges. In general, it is preferred to have a resilient member having a spring constant of at least $K \cdot L \cdot r/2n$, where r is the maximum distance between the contact surface and the main axis, L is the length, parallel to the main axis, of the contact surface of the working ledge and K is a constant of at least $K=10^{10}$ N/m$^3$, more preferably at least $K=5\sim10^{10}$ N/m$^3$ and most preferably at least $K=10^{11}$ N/m$^3$. This can be interpreted as if a tensioning of a spring by a compression of 1 mm should give the required force sufficient for achieving tribochemical reactions to occur. Preferred suitable spring types are leaf springs and wave springs.

Typical resilient movements are very small, typically less than 1 mm. These movements are typically only used for compensating for differences between the different working ledges and/or any inevitable wear. The working ledges 20 are now in contact with the cylinder bore with essentially the same force. The resilient member therefore preferably has a free length of at least 1 mm and preferably at least 5 mm.

Also the aligning in the axial direction is of importance. If the working ledge 20 is not absolutely parallel with the cylinder bore, only a small part of the working ledge 20 contacting surface 22 will actually be in contact with the cylinder bore. This is the main reason for allowing the tilting around the tilting axis 24. Therefore, preferably, each of the working ledges is movable in a respective ledge displacement direction that is directed radially with respect to the main axis. Furthermore, the force application arrangement is mechanically attached to each of the working ledges allowing a tilting of a respective working ledge around a respective tilt axis. This respective tilt axis is directed perpendicular to the main axis and is perpendicular to the respective ledge displacement direction. In the present embodiment, the tilt axis 24 is furthermore positioned at a same level in the main axis 11 direction as a middle point of the contact surface 22. This means that the pivoting properties of the working ledge 20 become similar independent of whether the instantaneous operation movement is upwards or downwards. In the present embodiment the working ledges 20 are attached to a respective ledge support arrangement 30 by a single attachment 32. This means that all force applied on the working ledge 20 from the ledge support arrangement 30 is applied in one point. In the present embodiment, the single attachment 32 coincides with the tilt axis 24. This leads to the fact that the ledge support arrangements 30 are arranged to apply the force on the respective working ledges 20 without causing any torque around the tilt axis 24. When the working ledge 20 by action of the working force applied by the ledge support arrangement 30 comes into contact with the cylinder bore, the very first contact is often one of the ends. The contact force between the working ledge 20 and the cylinder bore will then form a torque around the tilt axis 24, striving to align the working ledge 20 with the cylinder bore. Such a torque will continue to act until the entire working ledge 20 is in contact with the cylinder bore, in which situation the torque due to the contact forces are cancelling each other. In other words, this arrangement leads to a self-aligning of the working ledges 20, which is independent of the size of the applied working force.

In comparison with the spring-based solution of prior art honing equipment, such prior art spring loading uses the same springs for the working load as well as the height compensation and possible aligning mechanisms. This means that each height adjustment or tilting action will influence the working load and vice versa. Such interdependencies are acceptable in honing applications, where tool wear in a relatively short period of time will even out differences in load. However, for conditioning by means of tribochemical reactions, where the wear is almost negligible, the origin of the working load and the height adjustment and tilt aligning preferably are separated. Preferably, the main height adjustment is basically provided by the actuator, while the main origin of the working load is basically provided for by the resilient member.

In the embodiment of FIG. 1, the working ledges are mounted directly onto the tool in analogy with the place of traditional hones of a honing head, but with the addition of using a fixture featuring a spring suspension which provides equal load distribution across all ledges.

This concept admits an increased tolerance for unwished height differences between opposite ledges. Furthermore, it results in well aligned ledges in contact with the cylinder bore in the axial direction. This approach also removes the step of running in of honing stones, which is common in honing procedures. The contact surface of the tool can therefore also be designed in relation to the cylinder bore shape to obtain required contact properties.

Figure 3:
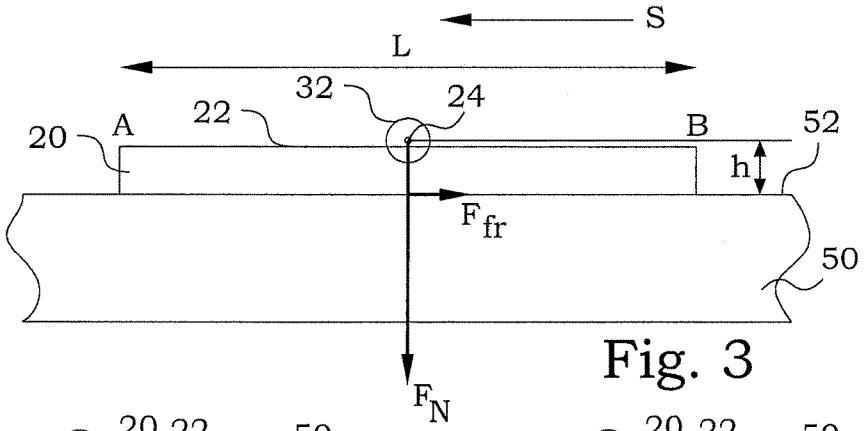
FIG. 3 is an illustration explaining friction forces on a working ledge.

During operation, additional forces are acting on the working ledges. In a preferred embodiment, for stable operation, the friction forces should not influence the aligning too much. In FIG. 3, a working ledge 20 is illustrated when being moved in contact with a cylinder bore wall 50. It is shown in this embodiment that distance h from the pivot point or tilt axis 24 to the working surface, i.e. the contact surface 22 of the working ledge is much smaller than the working ledge length L. Otherwise, the torque due to a friction force $F_{fr}$ will cause uneven loading on the advancing A and the receding B edges of the working ledge 20 on each stroke in a stroke direction S, creating a risk for scoring of the cylinder bore surface and fretting damage of the tool. The difference in loading between the advancing A and the receding B edges, normalized to the normal force $F_N$ applied to the working ledge 20, is proportional to a coefficient of friction μ for the surfaces in contact times the distance h between the tilt axis 24 and a cylinder bore surface 52 divided by the working ledge length L. Assuming that in the boundary lubrication regime, the coefficient of friction is around 0.1, it is desirable to keep the ratio h/L below 0.1, in which case the difference in loading on the advancing A and receding B edges will not exceed 1%. In other words, in a preferred embodiment a ratio between a closest distance h between the tilt axis 24 and the contact surface 22, and a length L of the contact surface 22 in the elongation direction, is smaller than 0.1. A pivot system at the base of the ledge holder thereby provides for ledge self-alignment also during the up- and down stroke.

Figure 4A:
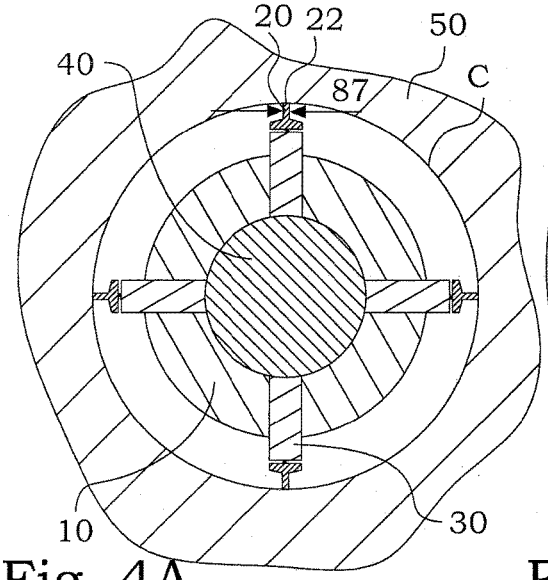
FIGS. 4A-D are axial cross-sectional views of different embodiments of tools for mechanochemical treatment of a cylinder bore.

In the embodiment of FIG. 1, the four working ledges were spread evenly around the main axis. Such an arrangement inserted in a cylinder bore is schematically illustrated in FIG. 4A. The contacting surfaces 22 of the working ledges 20 are the only contact points between the tool 1 and the cylinder bore 50.

Figure 4B:
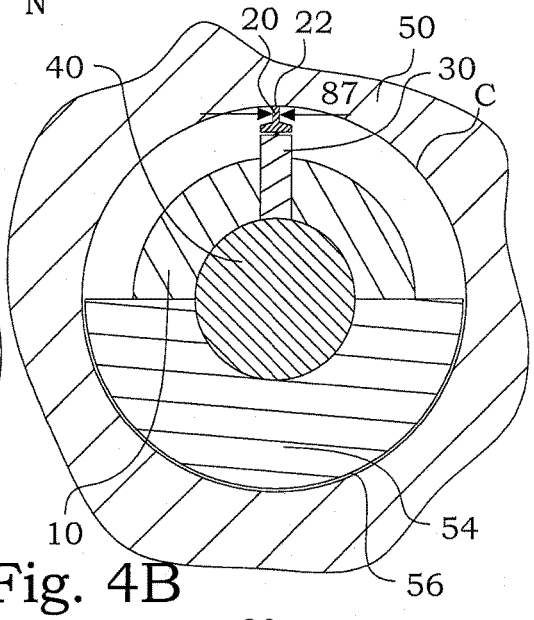

However, there are alternative designs as well. FIG. 4B illustrates an embodiment of a tool 1, having only one working ledge 20. In order to have a counteracting force a counter-support arrangement 54 is connected to the shaft 10. The counter-support arrangement 54 has a radially outwards directed contact area 56 that is larger, preferably much larger, than a contact area of the contact surface 22 of the working ledge 20. In this embodiment, the contact area 56 is at least one order of magnitude larger than the contact area 22. The pressure from the counter-support arrangement 54 onto the cylinder bore then becomes small in comparison with a pressure required for achieving true conditioning by means of tribochemical reactions. The counter-support arrangement 54 will there not contribute to the actual treatment but will only provide a counteracting force. Such an arrangement can be of interest if the working ledges 20 e.g. are extremely expensive or difficult to manufacture.

Figure 4C:
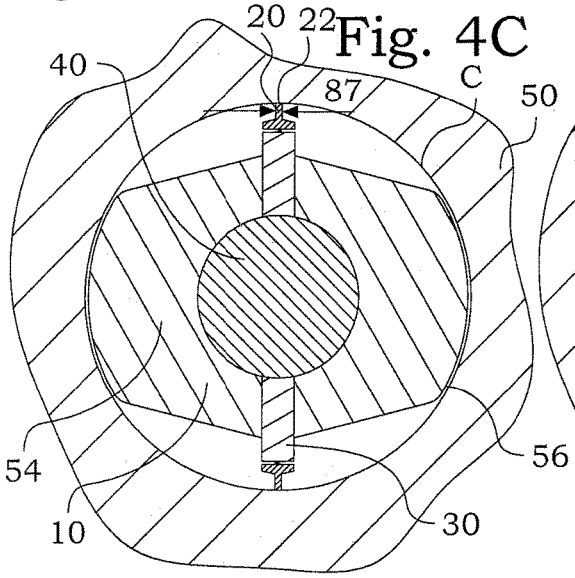

In FIG. 4C, another alternative embodiment is shown. Here, two working ledges 20 are used and the counter-support arrangement 54 comprises two contact areas 56. In this embodiment, the counter-support arrangement 54 merely provides a side support, reducing any bending action of the working forces applied to the working ledges 20. Also here, the areas of the contact areas 56 are preferably much larger than the contact surfaces 22 of the working ledges 20.

Figure 4D:
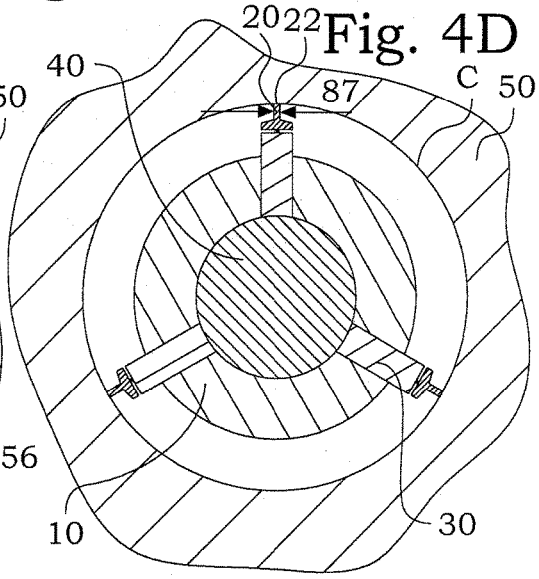

In order to remove the need for counter-support arrangement 54, at least three working ledges 20 spread around the shaft 10, as illustrated in FIG. 4D, are provided.

It is here in the FIGS. 4A to D easily noticeable that the width 87 of the contacting surfaces 22 is very small compared to a circumference C of the cylinder to by treated, which is the same as a circumference of the tool. This small fraction of contact area is a fundamental difference between honing and conditioning by means of tribochemical reactions.

Figure 5:
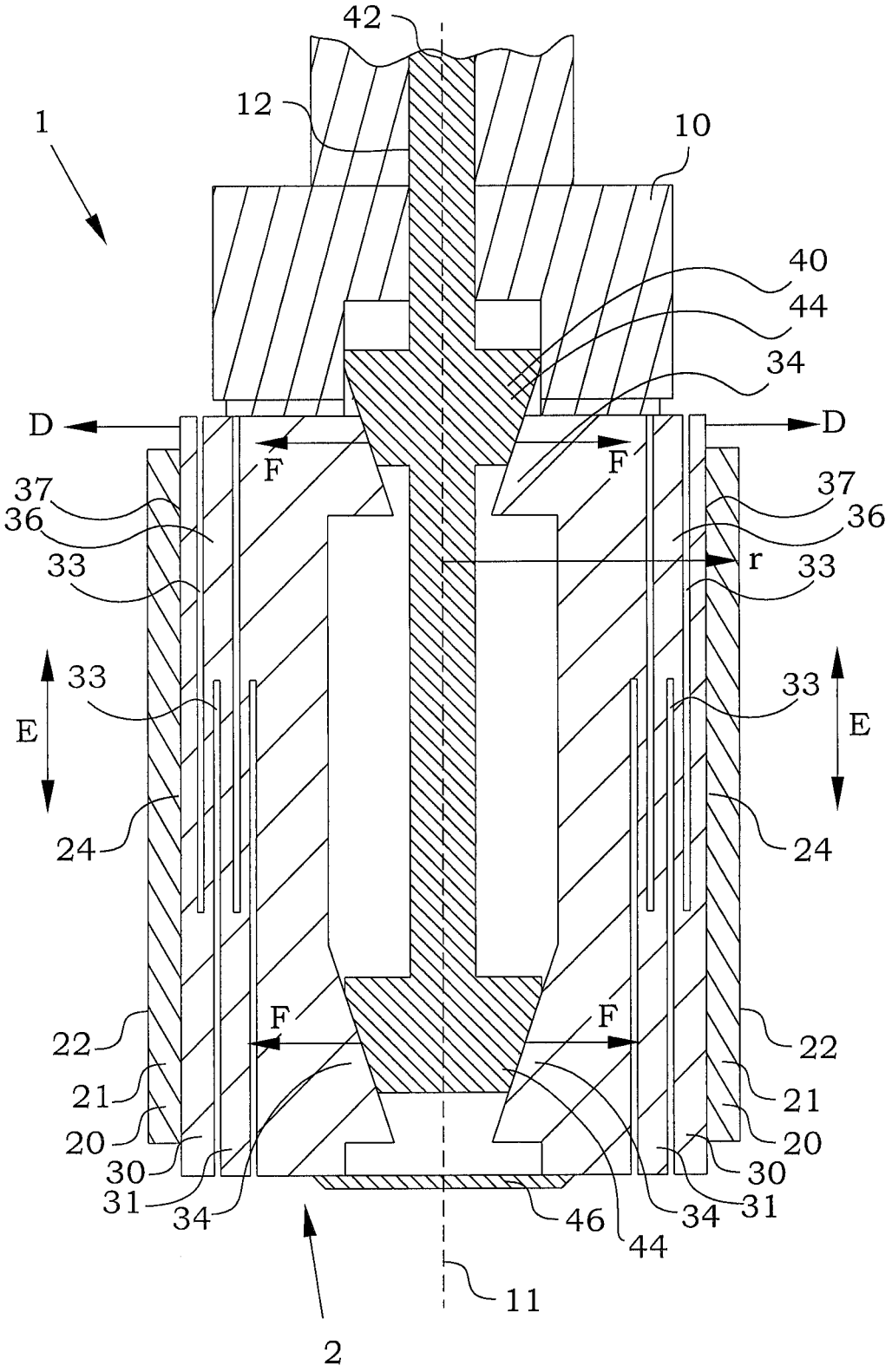
FIG. 5 is a partly cross-sectional illustration of another embodiment of a tool for mechanochemical treatment of a cylinder bore.

FIG. 5 illustrates another embodiment of a tool 1 for mechanochemical treatment of a cylinder bore. In this embodiment, the ledge support arrangements 30 are also resilient in the support displacement direction D. In this embodiment, the resilient members 36 of the ledge support arrangements 30 comprise axially directed slits 33 in the main body of the ledge support arrangements 30. The entire main body will therefore act as a spring providing a radial adjustability as well as permitting tilting actions of the working ledge 20, In this embodiment, the working ledge 20 is connected to the support arrangements 30 along its entire length, which means that the working force is transferred to all parts of the working ledge 20. However, since the mounting of the working ledges 20 is centred with respect to the pattern of slits 33, the ledge support arrangements 30 are also here arranged to apply the force on the respective working ledges 20 without causing any torque around the tilt axis 24. This approach permits an easy mounting of the working ledges 20 and prohibits any bending action on the working ledge 20 when the working load is applied. It is also believed that conventional honing equipment easily can be modified to provide such an embodiment.

In the present embodiment, the actuator 40 has a rod 42 provided in the same piece as the cones 44. When the force is to be applied on the ledge support arrangements 30, the rod 42 is pushed down in the axial direction, whereby this pushing force is transformed into a radially directed force F on the ledge support arrangements 30. This embodiment of the actuator 40 can be applied to all other embodiments illustrated in the present disclosure. Likewise can the actuator embodiment illustrated in FIG. 1 be used together with the ground embodiment of FIG. 5, as an alternative.

Figure 6:
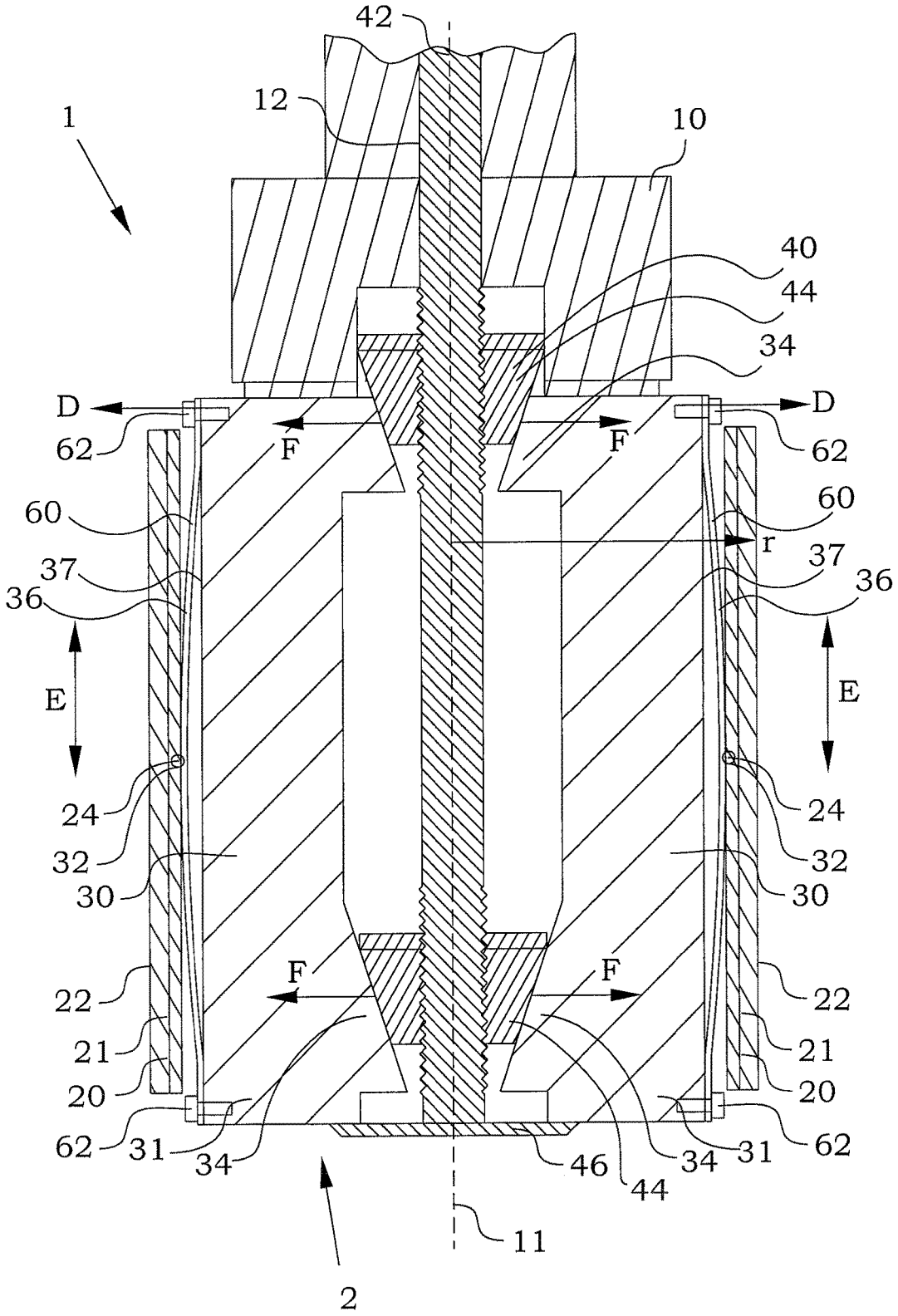
FIG. 6 is a partly cross-sectional illustration of yet another embodiment of a tool for mechanochemical treatment of a cylinder bore.

FIG. 6 illustrates yet another embodiment of a tool 1 for mechanochemical treatment of a cylinder bore. In this embodiment, the resilient member 36 comprises a leaf spring 60, which is pre-tensioned by adjustment screws 62. In this way any height compensation distance can be minimized by in advance adjusting the adjustment screws 62. The space needed for comprising the resilient member 36 can therefore be very small.

Figure 7:
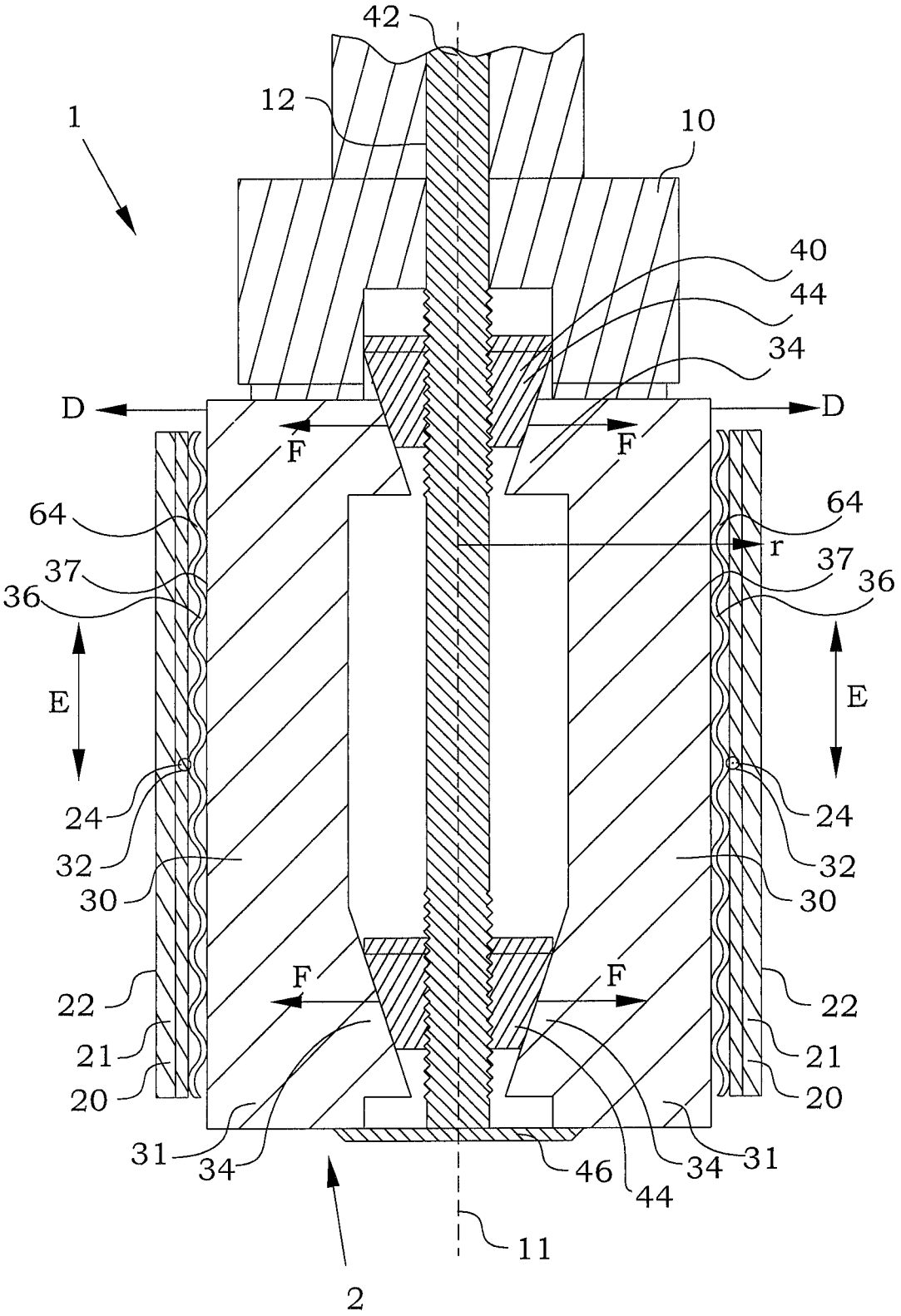
FIG. 7 is a partly cross-sectional illustration of yet another embodiment of a tool for mechanochemical treatment of a cylinder bore.

FIG. 7 illustrates yet another embodiment of a tool 1 for mechanochemical treatment of a cylinder bore. In this embodiment, the resilient member 36 comprises a wave-shaped spring 64. The working ledges 20 is connected in a point centred with respect to the wave-shaped spring 64 and pivoting takes place around this attachment 32. The position of the wave-shaped spring 64 is thereby fixed. The space needed for comprising the spring arrangements 36 is also here very small.

Figure 8:
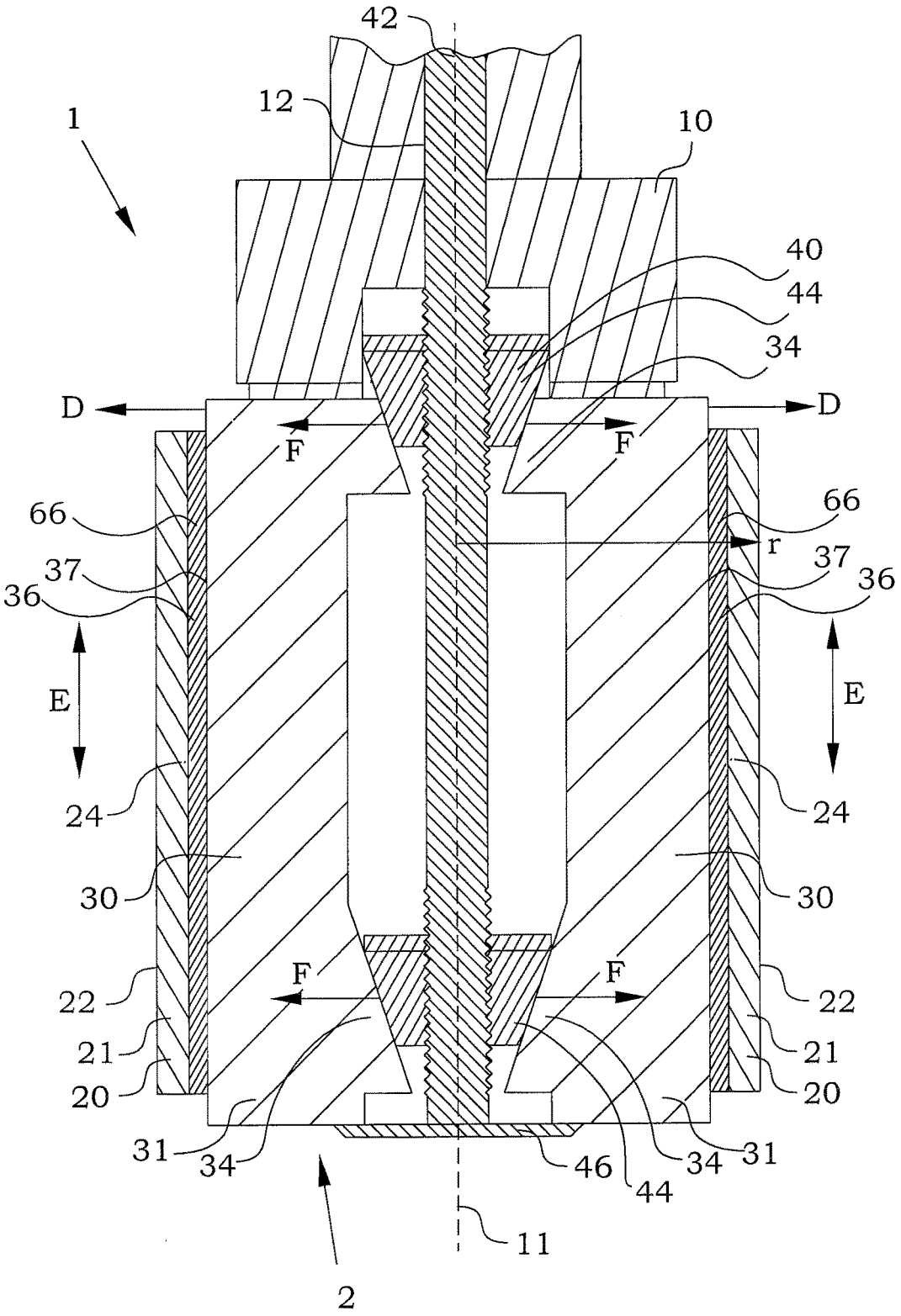
FIG. 8 is a partly cross-sectional illustration of yet another embodiment of a tool for mechanochemical treatment of a cylinder bore.

FIG. 8 illustrates yet another embodiment of a tool 1 for mechanochemical treatment of a cylinder bore. In this embodiment, the resilient member 36 comprises a layer of resilient material 66 as the connecting material between the working ledges 20 and the main ledge support structure 30. One advantage with such an approach is that the space between the working ledges 20 and the main ledge support structure 30 is filled, which prohibits any particles to enter into such a volume and disturb the operation. The spring action is typically not ideal, since compression of one part of the resilient material volume may influence the properties of other parts.

However, such an embodiment may instead be preferably used together with any of the other solutions. For example, having a central spring and a central main connection point in a void in the centre of an weak elastic material, will both provide an excellent spring action and protection against e.g. abrasive particles into the spring mechanism.

Figure 9:
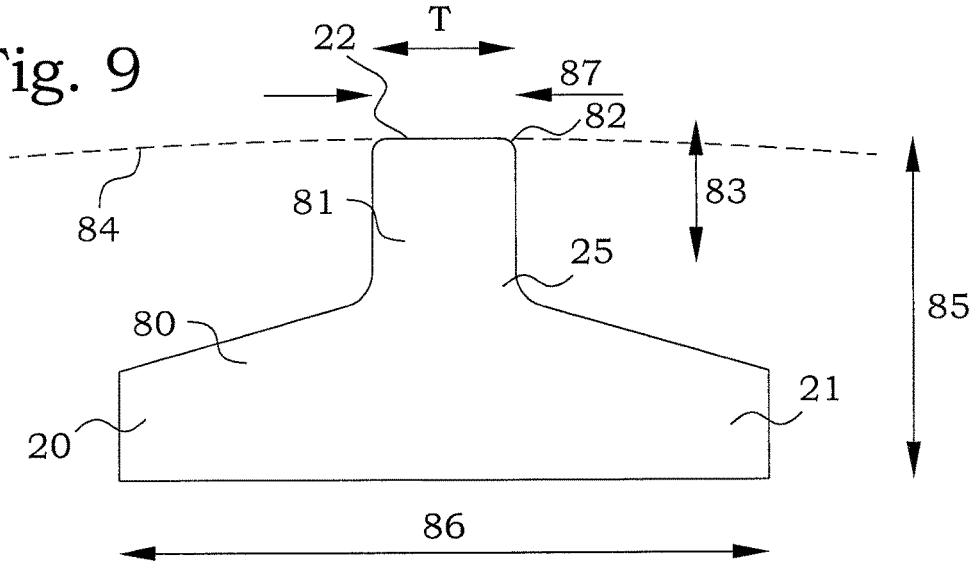
FIG. 9 illustrates shapes and properties of an embodiment of a working ledge.

Since the working ledges of the conditioning by means of tribochemical reactions treatment are made from very hard materials, the wear of the working ledges is very small indeed. The shape of the ledges is therefore preserved to a large extent during the main part of the ledge life time. Therefore, considerations concerning the actual design of the ledges are as discussed further above of interest. An embodiment of a working ledge 21 for mechanochemical treatment is illustrated in FIG. 9. The working ledge 21 for mechanochemical treatment comprises a base part 80 and a narrower top part 81. As mentioned further above a width 87 of the working ledge in a circumferential or tangential direction T centred around the main axis is preferably less than r/2n, where r is the maximum distance between the contact surface and the main axis. The outermost portion of the top part 81 constitutes the contact surface 22. The contact surface has a curvature, illustrated by the tool top radius 84, which preferably is exactly equal to the radius of the cylinder bore to be treated, providing for a conformal frictional contact between the cylinder bore surface and the working ledges. This reduces the risk of tool wear. The edges 82 of the contact surface 22 in the tangential direction T are rounded. This is advantageous for two reasons. First, the sliding between the contact surface 22 and the cylinder lining becomes smoother without risk for catching irregularities on the lining by a sharp edge. Secondly, the process liquid that is present during the treatment will be pushed into the contact area. It is easily seen in FIG. 9 that the contact surface 22 has a convex curvature in a cross-section perpendicular to the main axis. The convex curvature has, in each point of the contact surface, a radius of curvature being equal to or less than a closest distance from that point to the main axis.

The narrow contact surfaces also facilitates the tool preparation. A tool preparation of working stones in the same geometrical shape and size as prior art honing stones would take unreasonably long time.

As mentioned before, the contact surface 22 has preferably a very smooth surface finish, which reduces risk for tool scoring. The width 87 of the contact surface is preferably small, giving a narrow working ledge 21 capable of operating with high tool pressures. As mentioned further above the width 87 of the working ledge 20 in a circumferential or tangential direction T centred around the main axis is preferably less than r/2n, where r is the maximum distance between the contact surface 22 and the main axis. The preferred tool width 87 in many actual applications is in the order of 1 to 5 mm. The height 83 of the top part 81 is relatively large, giving a relatively long wear zone. This enables e.g. reshaping of the contact surfaces 22 and the edges 82 if inevitable wear has changed the shape from the ideal one. The working ledges 21 for mechanochemical treatment can thereby be used over and over again. The working edge height 83 is 1 to 10 mm, and more preferably, 2 to 5 mm. Since the sides of the top part 81 are vertical, the width of the contact surface 22 does not change after such reshaping and/or repolishing. By keeping the total height 85 small, the working ledge 21 for mechanochemical treatment can be used for small cylinders as well, with a smaller radius of curvature of the contact surface. The broad 86 base 80 of the working ledge 21 for mechanochemical treatment is advantageous since it reduces vibrations and the tool base also helps in aligning the contact surface radially with the cylinder bore.

Figure 10:
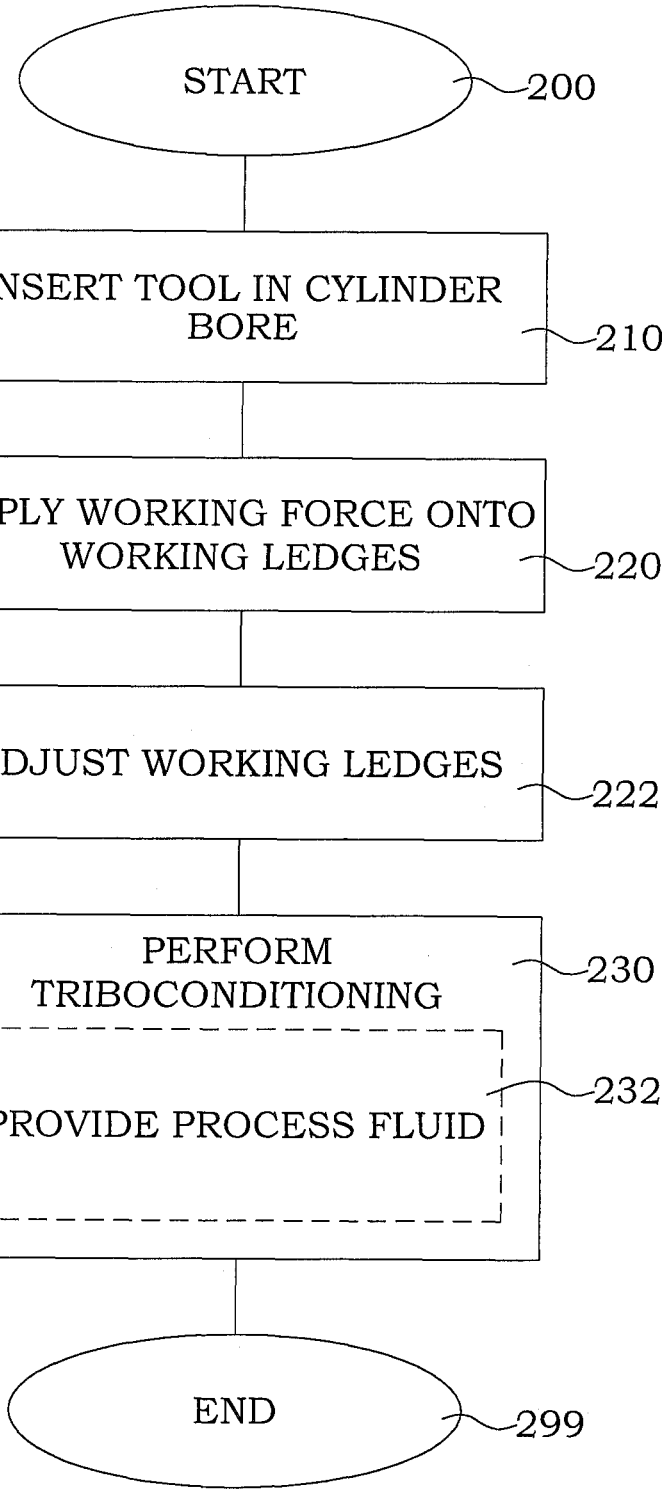
FIG. 10 is a flow diagram of steps of an embodiment of a method for mechanochemical treatment of a cylinder bore.

FIG. 10 is a flow diagram of steps of an example of a method for mechanochemical treatment of a cylinder bore, and more particularly for in-manufacture running-in of cylinder bores. The process starts in step 200. A cylinder block or a cylinder liner to be treated is provided. In step 210 a tool for mechanochemical treatment is inserted into a cylinder bore of the cylinder block or the cylinder liner. The tool for mechanochemical treatment comprises at least one working ledge having a generally elongated contact surface. The working ledge(s) is(are) directed radially outwards, with respect to a main axis of the cylinder bore and with the elongation direction parallel to the main axis. The contact surface has a convex curvature in a cross-section perpendicular to an elongation direction of the contact surface. The convex curvature is constant along essentially the entire elongation of the contact surface. In step 220, a respective working force is applied onto the working ledges via a respective ledge support arrangement that is movable in a respective support displacement direction directed radially with respect to the main axis. In step 222, a position of the working ledges is adjusted to place the contact surfaces in contact with an inner surface of the cylinder bore along an entire length of the contact surface. This is done by letting the applied force move the working ledge in the displacement direction and tilt the working ledge around a respective tilt axis. The tilt axis is directed perpendicular to the main axis and perpendicular to the support displacement direction. In step 230, a conditioning by means of tribochemical reactions of the inner surface of the cylinder bore is performed by rotating the tool around the main axis and translating the tool along the main axis within the cylinder bore. Contact pressure between the tool ledges and the bore surface is preferably maintained between 1% and 100% of an ultimate strength of the material of which the cylinder bore lining is made. Preferably, the method also comprises a step 232, in which a process fluid is provided to the inner surface of the cylinder bore during the step of performing a conditioning by means of tribochemical reactions.

The process liquid preferably comprises a base oil and a set of additives needed for the tribofilm generation. As the base oil, mineral oils, polyalfaolefins, fatty esters, and polyalkylene glycols of appropriate viscosity grades can be used. The preferred viscosity range of the base oil used is between 1 and 20 cSt at 100° C. As additives, a number of metallocomplexes, including but not limited to thiocarbamates, thiophosphates, thioxanthates of refractory, metals can preferably be used. Other appropriate additives include boric acid, borate esters, phosphate esters, zinc dithiophosphates, ashless dithiophosphates, ashless dithiocarbamates, refractory metal dichalcogenides, inorganic fullerene-like nanoparticles made of refractory metal dichalcogenides, carbon nanoparticles and similar chemistries. The process fluid may also contain antioxidants, corrosion inhibitors and detergents. Other suitable classes of process fluids are emulsifiable and water soluble products, such as ISO 6743/7 M-family metalworking fluids. The advantage of using such emulsions is their superior cooling capacity, allowing for higher process speeds. In soluble oils, certain EP functionality can be included directly in the water phase, e.g. by using ammonium tungstate in the water phase and an active sulfur source, such as organic polysulfides, sulfurized olefins, or sulfurized fats, in the oil phase. An example of suitable process fluid formulation is given in Table 1.

TABLE 1

Process fluid formulation for in-manufacture running-in of cylinder bores

| Component | Weight percent |
|---|---|
| Tungstic acid, fatty amine adduct | 1-15 |
| Organic polysulfide | 1-15 |
| Phosphate ester | 0-15 |
| Antioxidant (Irganox L135) | 0.1-0.5 |
| Mineral oil | the rest |

The process ends in step 299, preferably when the optimum degree of processing is reached.

Preferably, the at least one working ledge are at least three working ledges, whereby the respective working force are applied to at least three working ledges spread around the main axis. The respective working forces are of a same magnitude.

Figure 11A:
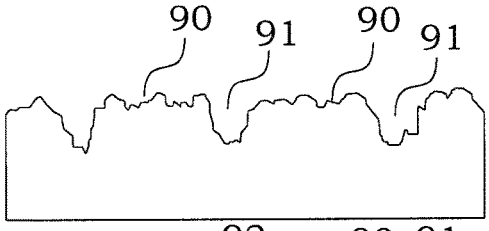
FIGS. 11A-D are diagrams illustrating different phases in a conditioning by means of tribochemical reactions treatment.
Figure 11B:
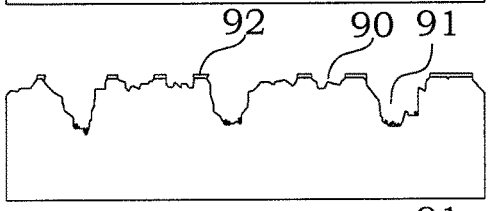

The conditioning by means of tribochemical reactions should as mentioned above be continued until an optimum surface condition is reached. In FIGS. 11A-D, diagrams are schematically illustrating the process of conditioning by means of tribochemical reactions. In the diagram of FIG. 11A, a portion of an untreated cylinder bore surface is illustrated. The surface typically comprises rough plateaus 90 of material separated by valleys of a honing pattern 91. Conditioning by means of tribochemical reactions is then applied. After a while, the surface condition may look as in the diagram of FIG. 11B. The rough plateaus are beginning to be flattened by burnishing. However, the plateaus 90 have still significant rough portions. On the flattened parts a solid lubricant tribofilm 92 has started to develop. The solid lubricant tribofilm is not, as could be concluded by the highly schematic drawing, an additional layer of material, but is instead a continuously changing composition of the base material. This stage corresponds to an undertreated surface.

Figure 11C:
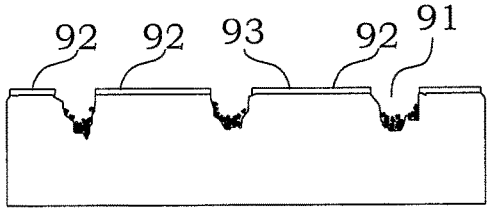

In the diagram of FIG. 11C, a cylinder bore surface with an optimum conditioned treatment by means of tribochemical reactions is illustrated. Most of the plateaus are burnished away into flat plateaus 93, covered by a solid lubricant tribofilm 92. The solid lubricant tribofilm 92 is coherent over relatively large areas. The main part of the honing pattern 91 is, however, preserved. This makes it possible for wear particles and liquid lubricants to reside, when the surface is in use.

Figure 11D:
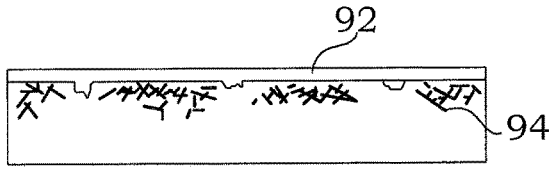

Conditioning by means of tribochemical reactions can also be overworked. In the diagram of FIG. 11D, such an overworked surface is illustrated. The honing pattern is completely gone and a fully covering solid lubricant tribofilm 92 is produced. Possibly, crack initiation 94 has started. Such a surface is less suitable for use.

The ideas of the present disclosure have been used for the conditioning by means of tribochemical reactions treatment of a cylinder lining, in order to illustrate the advantages. A ledge comprising WC—Co cemented carbide, was used to produce a tungsten disulfide tribocoating on the surface of a cylinder liner for an automotive internal combustion engine. Cylinder liners for a production 13 L heavy-duty diesel engine were treated according to the method disclosed herein using a modified Nagel honing machine with the honing head modified as herein described. The contact pressure between the ledge and the liner was in the range of 100 to 500 MPa, or even somewhat lower. The process fluid contained 2 wt % tungsten and 2 wt % active sulfur carried in a hydrocarbon solvent with a kinematic viscosity of 2 cSt at 100° C.

The tribological properties of the treated liner were compared to those of the original one. To evaluate the effect of conditioning by means of tribochemical reactions on piston ring/cylinder liner friction and wear, a reciprocating tribometer was used. Normal load and friction forces were measured with strain-gauges. The piston rings were the compression rings from the same engine.

The friction measurements were carried out with a load of 50 N, stroke length of 25 mm, and speeds from 25 to 375 rpm. The ring/liner tribocontact was lubricated by fresh SAE 30 engine oil. Each speed regime was maintained for 20 sec. The wear test was carried out using harsher conditions: lubrication by "aged" SAE 30 oil, load of 360 N, speed of 900 rpm. The test duration was 4 hours. Both tests were carried out at room temperature.

Figure 12A:
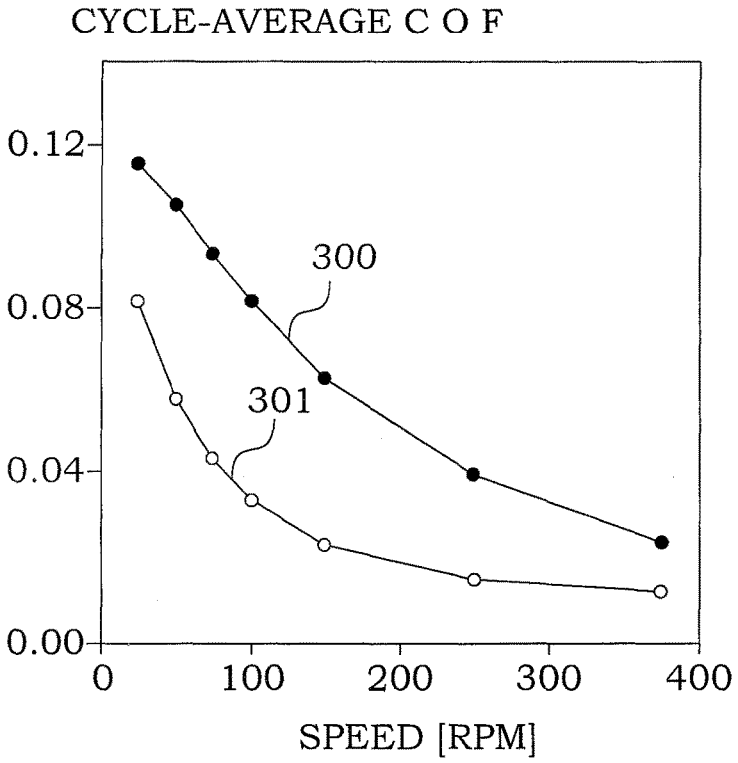
FIGS. 12-A-B are diagrams illustrating the advantages by conditioning by means of tribochemical reactions.
Figure 12B:
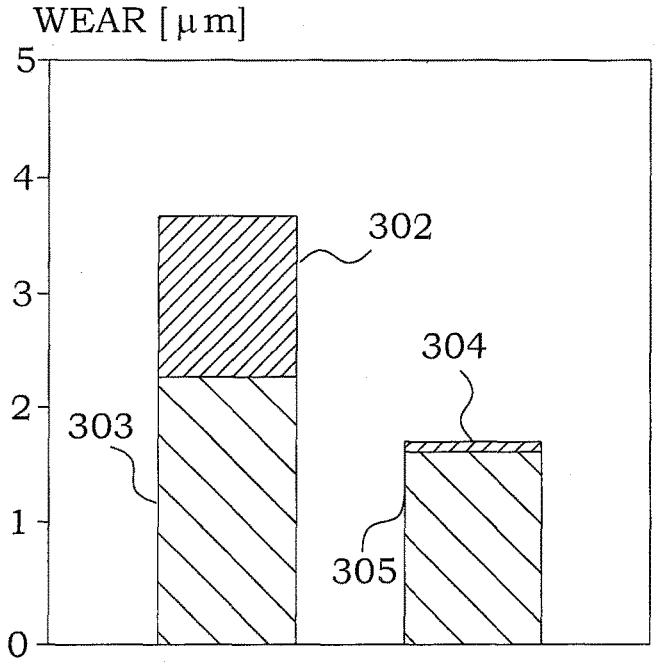

These experiments demonstrated significant reduction in friction and ring wear for conditioned liners, see FIG. 12A-B. In FIG. 12A, the diagram illustrates the cycle-averaged constant of friction at different speed for a regular liner, curve 300, and for a liner according to the present ideas, curve 301. The improvement is striking. In FIG. 12B, the ring wear 302 and liner wear 303 for a regular liner are illustrated side by side with the ring wear 304 and liner wear 305 for a liner treated according to the present invention.

Figure 13:
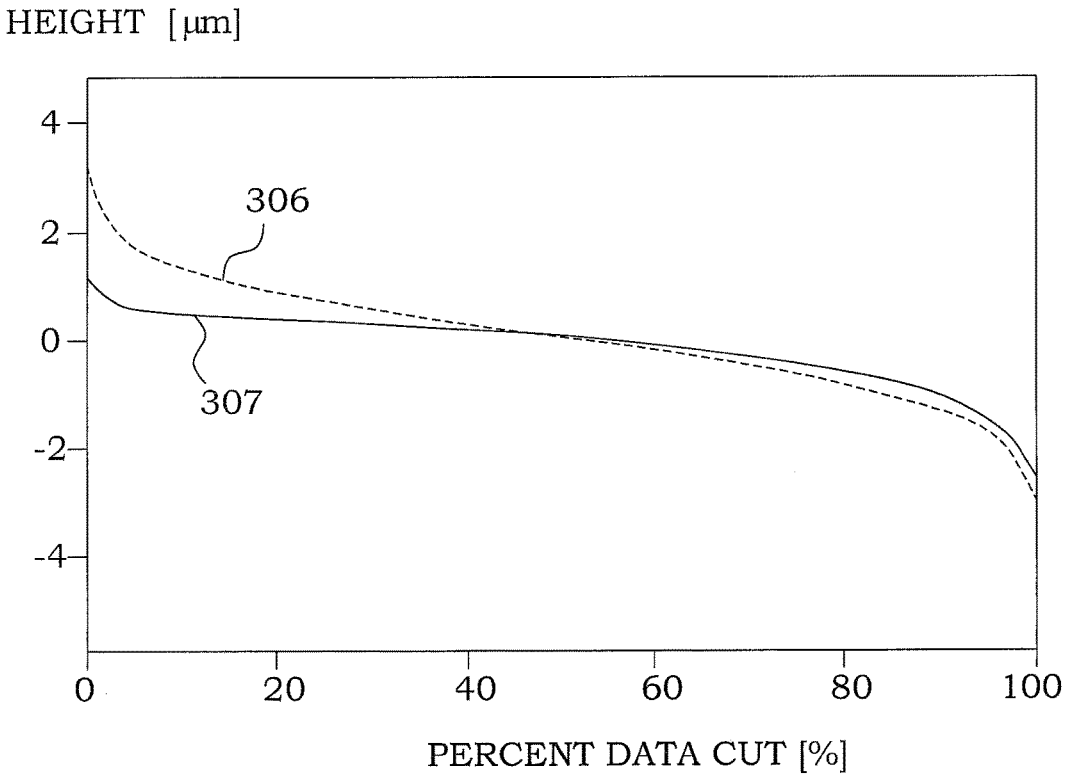
FIG. 13 is a diagram comparing surface roughness of a regular liner and a liner treated by conditioning by means of tribochemical reactions.

FIG. 13 presents the changes in the surface roughness profile of a cylinder liner after conditioning by means of tribochemical reactions. The curve 306 corresponds to the regular liner and the curve 307 corresponds to the treated liner. The following characteristic changes may be noted: (i) a decrease in the mean roughness depth, $R_z$, arithmetic average, $R_a$, peak, $R_{pk}$, and core, $R_k$, roughness, (ii) a decrease in reduced peak height to reduced valley depth ratio, $S_{pk}/S_{vk}$, with increasingly negative skewness of height distribution, $S_{sk}$, based on ISO 13565 and ISO 25178.

As a conclusion, a method for in-manufacture running-in of cylinder bores applied to cylinder blocks and/or cylinder liners with the aid of a modified honing machine, using hard, smooth, non-abrasive working ledges with $R_a$<0.1 μm, Vickers number >800 HV and Young modulus above 200 GPa, with a fixation mechanism providing for equal loading, self-alignment, compensation for wear and serviceability of ledges, and relying on the mechanochemical surface finishing concept, i.e. the tribofilm formation being initiated by high contact pressure between the working ledges and the bore surface, and deploying a process fluid containing one or more active ingredients used as the feedstock for tribofilm formation, results in a modified surface roughness profile of the bore with reduced $R_z$, $R_a$, $R_{pk}$, $R_k$ and $S_{pk}/S_{vk}$ and formation of a solid lubricant tribofilm on the bore surface.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. A tool for mechanochemical treatment of a cylinder bore, comprising:

a shaft having a main axis;

a number n of working ledges, where n≥1; and a force application arrangement, configured for applying a working force, directed radially outwards from said main axis, on said working ledges;

said working ledges comprising a wear-resistant material with a Vickers number above 800 HV and Young modulus above 200 GPa;

wherein each working ledge having a, parallel to said main axis generally elongated, contact surface, facing away from said main axis, said contact surface being polished and essentially non-abrasive, having a surface roughness $R_a$ below 1 μm;

said contact surface having a convex curvature in a cross-section perpendicular to said main axis, said convex curvature having, in each point of said contact surface, a radius of curvature being equal to or less than a closest distance from said point to said main axis;

wherein a width of said contact surface in a circumferential direction centred around said main axis being less than r/2n, where r is the maximum distance between said contact surface and said main axis;

said working force applied on each working ledge being at least $P \cdot L \cdot r/2n$, where $P=10^7$ Pa and L is the length, parallel to said main axis, of said contact surface of said working ledge.

2. The tool according to claim 1, wherein said force application arrangement comprises an actuator, supported by said shaft and being capable of providing said working force, and a resilient member arranged between said actuator and said working ledge.

3. The tool according to claim 2, wherein said resilient member has a spring constant of at least $K \cdot L \cdot r/2n$, where $K=10^{10}$ N/m$^3$.

4. The tool according to claim 2, wherein said resilient member has a free length of at least 1 mm.

5. The tool according to claim 1, wherein each of said working ledges are movable in a respective ledge displacement direction being directed radially with respect to said main axis, and that said force application arrangement is mechanically attached to each of said working ledges allowing a tilting of a respective said working ledge around a respective tilt axis, said tilt axis being directed perpendicular to said main axis and perpendicular to said respective ledge displacement direction.

6. The tool according to claim 5, wherein said force application arrangement is arranged to apply said working force on each of said working ledges without causing any torque around said tilt axis.

7. The tool according to claim 3, wherein said resilient member has a free length of at least 1 mm.

8. The tool according to claim 2, wherein each of said working ledges are movable in a respective ledge displacement direction being directed radially with respect to said main axis, and that said force application arrangement is mechanically attached to each of said working ledges allowing a tilting of a respective said working ledge around a respective tilt axis, said tilt axis being directed perpendicular to said main axis and perpendicular to said respective ledge displacement direction.

9. The tool according to claim 3, wherein each of said working ledges are movable in a respective ledge displacement direction being directed radially with respect to said main axis, and that said force application arrangement is mechanically attached to each of said working ledges allowing a tilting of a respective said working ledge around a respective tilt axis, said tilt axis being directed perpendicular to said main axis and perpendicular to said respective ledge displacement direction.

10. The tool according to claim 4, wherein each of said working ledges are movable in a respective ledge displacement direction being directed radially with respect to said main axis, and that said force application arrangement is mechanically attached to each of said working ledges allowing a tilting of a respective said working ledge around a respective tilt axis, said tilt axis being directed perpendicular to said main axis and perpendicular to said respective ledge displacement direction.

11. The tool according to claim 7, wherein each of said working ledges are movable in a respective ledge displacement direction being directed radially with respect to said main axis, and that said force application arrangement is mechanically attached to each of said working ledges allowing a tilting of a respective said working ledge around a respective tilt axis, said tilt axis being directed perpendicular to said main axis and perpendicular to said respective ledge displacement direction.

12. The tool according to claim 8, wherein said force application arrangement is arranged to apply said working force on each of said working ledges without causing any torque around said tilt axis.

13. The tool according to claim 9, wherein said force application arrangement is arranged to apply said working force on each of said working ledges without causing any torque around said tilt axis.

14. The tool according to claim 10, wherein said force application arrangement is arranged to apply said working force on each of said working ledges without causing any torque around said tilt axis.

15. The tool according to claim 11, wherein said force application arrangement is arranged to apply said working force on each of said working ledges without causing any torque around said tilt axis.

* * * * *